United States Patent [19]

Rosen

[11] 4,117,423

[45] Sep. 26, 1978

[54] DUAL MODE MULTIPHASE POWER DIVIDER

[75] Inventor: Harold A. Rosen, Santa Monica, Calif.

[73] Assignee: Hughes Aircraft Company, Culver City, Calif.

[21] Appl. No.: 726,078

[22] Filed: Sep. 23, 1976

[51] Int. Cl.[2] ..... H01P 5/12; H01P 1/18

[52] U.S. Cl. ..... 333/9; 333/21 A; 333/31 A

[58] Field of Search ..... 333/6, 9, 11, 21 A, 333/31 A

[56] References Cited

U.S. PATENT DOCUMENTS

| | | | |
|---|---|---|---|
| 3,445,853 | 5/1969 | Hatkin | 333/11 X |
| 3,668,567 | 6/1972 | Rosen | 333/21 A |
| 3,731,236 | 5/1973 | Di Tullio et al. | 333/21 A X |
| 3,936,838 | 2/1976 | Foldes | 333/6 X |

*Primary Examiner*—Paul L. Gensler

*Attorney, Agent, or Firm*—Ray A. Cardenas; John Holtrichter, Jr.; W. H. MacAllister

[57] ABSTRACT

A transmission system for use in a communications satellite is disclosed which utilizes a power divider providing equal power output from N output ports having a uniform phase progression from port to port, the sense of which depends upon which of two input ports is excited. In an illustrated embodiment, one input port generates a first sense of circular polarization and the other generates the opposite sense. The two oppositely polarized circular waves are applied to the multiphase power divider. The cylindrical-bodied power divider has N output ports, where N is an odd integer, arranged at 360°/N about the cylindrical surface. Disposed within the power divider is an N-bladed septa for providing power division and isolation. A 180° phase inverter is connected to (N-1)/2 output ports for providing a wave having a phase progression of 180°/N from the power divider.

4 Claims, 4 Drawing Figures

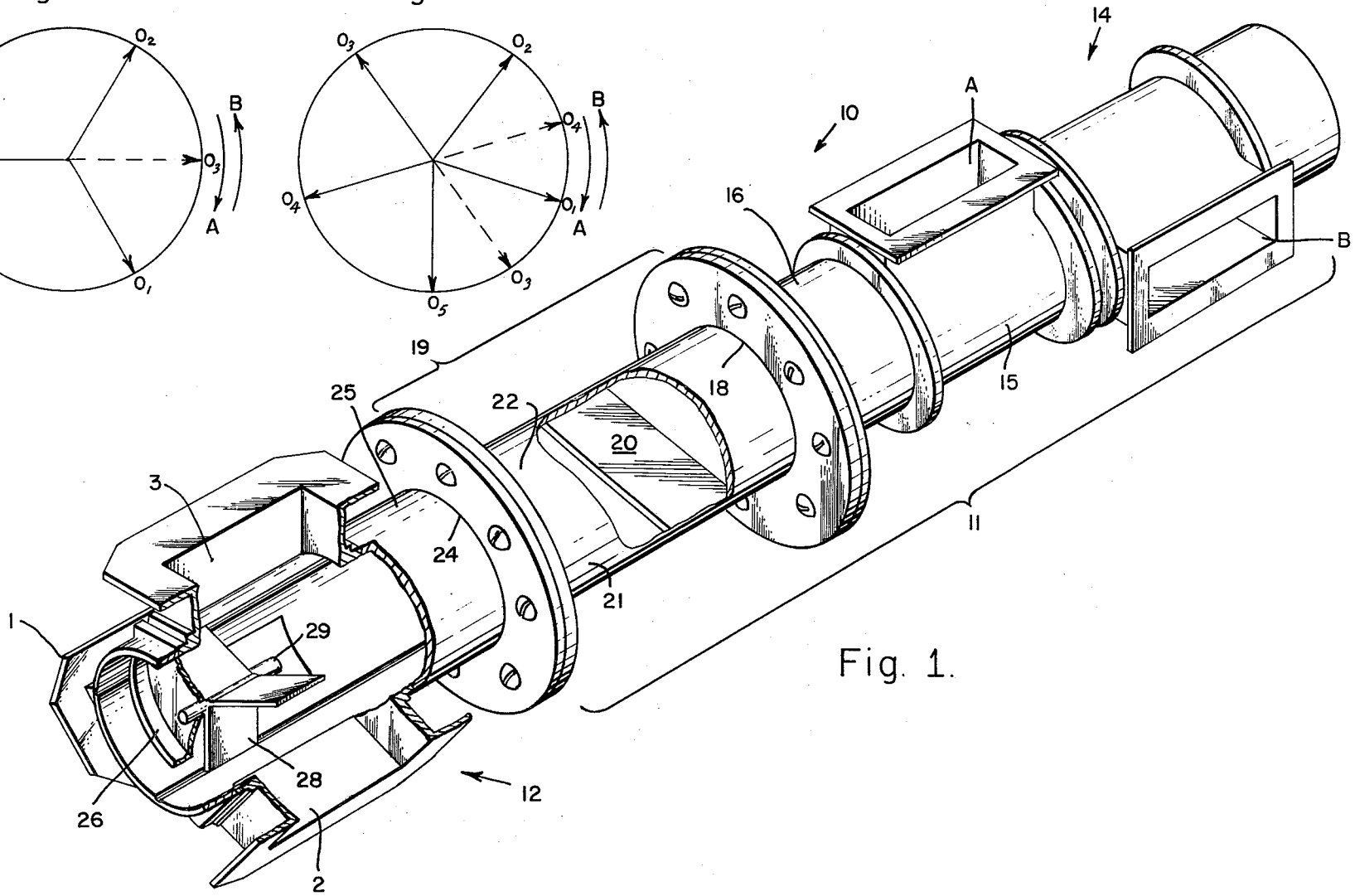
Fig. 1.
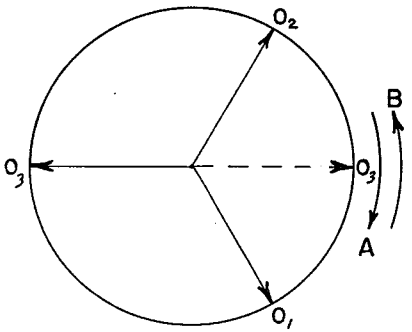
Fig. 2.
Fig. 3.

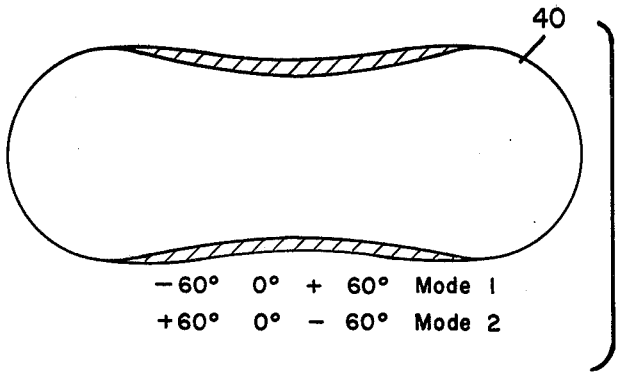
Fig. 4.
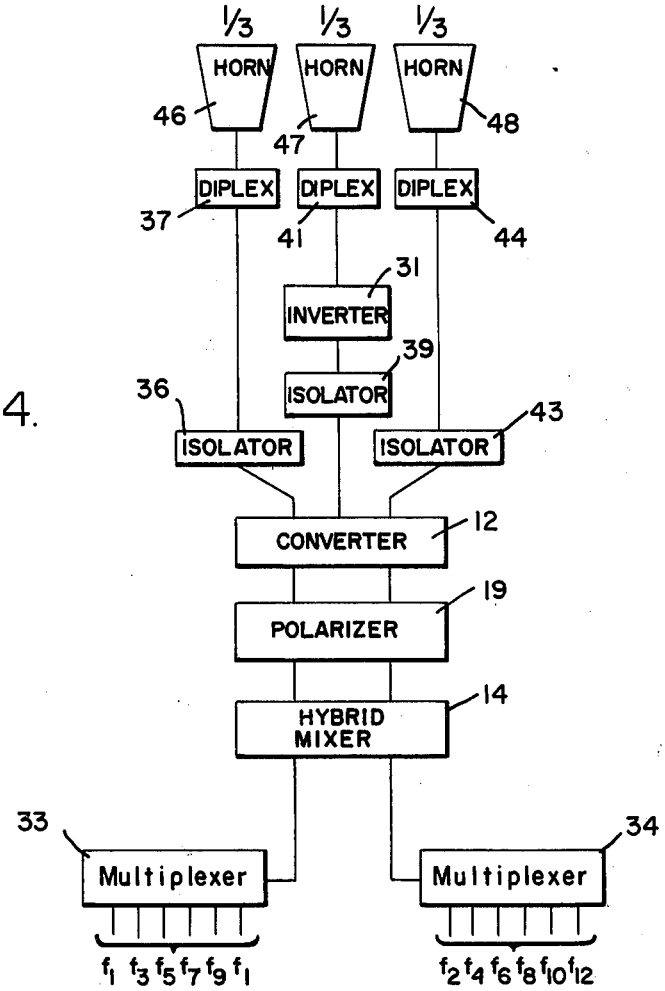
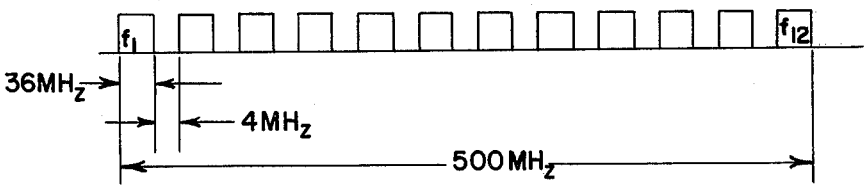

DUAL MODE MULTIPHASE POWER DIVIDER

BACKGROUND OF THE INVENTION

1. Field of the Invention

This invention relates generally to microwave transmission systems and in particular relates to a dual mode multiphase power divider.

2. Description of the Prior Art

In many microwave applications it is necessary to increase the transmitting power, reduce satellite intermodulation loss and provide beam shaping. One method of achieving the above objectives and also providing signal isolation is to channelize the transmitter frequency band into a number of smaller frequency bands. These channels are combined by a group of filters called a multiplexer. The performance of a multiplexer is improved when adequate guard bands exist between channels, but guard bands themselves represent unused bandwidth. When two multiplexers are used to combine the signals, alternate channels can be combined in each, so that the multiplexers become simple, efficient, and introduce a minimum of delay distortion. Two antennas, or two isolated ports of a single antenna must be provided a dual multiplexer transmitter. This invention deals with a new method of providing two isolated ports to a single antenna, each of which generates nearly the same beam pattern of the same polarization. A multiple antenna feed having a uniform phase progression is used, the sense of the phase progression is determined by which of the ports is excited. Such an arrangement was described in U.S. Pat. No. 3,680,143 which issued to J. S. Ajioka, et al. on July 25, 1972. With such antenna structures a shaped beam is realized by a plurality of linearly disposed offset feeds at the focal region of a reflector. The feeds are energized in a manner to produce different senses of phase progression across the aperture. The resulting patterns are sufficiently close so as to overlap. In an exemplary antenna having three feeds the relative phase progression across the adjacent horns in one mode might be +60°, 0°, and −60°, and in another mode −60°, 0°,and +60°. A power divider which has been used for providing such a phase progression is disclosed in U.S. Pat. No. 3,843,941 which issued to Thomas Hudspeth, et al. on Oct. 22, 1974. Such a power divider is realized by having 2 input ports feed into a cavity with a common conductive wall, several conductive septa and 3 output ports. This power divider is a rather complex device in a 3 output port configuration and a greater number of output ports may be extremely difficult to achieve utilizing the techniques of that patent.

OBJECTS AND SUMMARY OF THE INVENTION

Accordingly, it is an object of the present invention to provide an improved dual mode transmission system.

It is another object of the present invention to provide a dual mode transmitter system utilizing a simplified and less expensive power divider.

It is yet another object to provide a dual mode power divider providing a multiphase output signal having a particular sense of phase progression for each mode, and capable of feeding a large number of antenna horns.

In accordance with the foregoing objects a dual mode power divider includes a circular waveguide member for receiving first and second circularly polarized signals having opposite senses. N output ports, N being an odd integer, are spaced 360/N° about said circular waveguide member. An N-bladed septa is disposed within the converter, each septum being at an angle of 360°/N from the preceding and succeeding septum and disposed so as to isolate adjacent output ports. Phase inverters are coupled to (N-1)/2 output ports for providing a phase inversion of 180° to the respective signals. The phase progression of the first mode output signals has a first sense while the phase progression of the second mode output signal has an opposite sense. The phase separation in 180/N degrees.

BRIEF DESCRIPTION OF THE DRAWINGS

FIG. 1 is a perspective view of a dual mode power divider according to an embodiment of the present invention.

FIG. 2 is a vector diagram of a dual mode diagram three phase power divider of FIG. 1 illustrating the output phase progressions.

FIG. 3 is a vector diagram of a dual mode five-phase power divider illustrating the output phase progressions.

FIG. 4 is a schematic block diagrm of a transmitter system utilizing a dual mode three-phase power divider according to the present invention.

Referring more specifically to FIG. 1, a dual mode three phase power divider 10 according to a first embodiment of the present invention is described. The power divider 10 is characterized by two input ports, labeled A and B, and three output ports, labeled 1, 2, and 3. The power divider 10 receives input signals at the input ports A and B and in turn provides a 3-phase output for each input. The first signal results in a first output signal having a phase progression of +60°, 0°, and −60° from the output ports 1, 2, and 3, respectively. The second output signal has a phase progression of −60°, 0°, and +60° from the same output ports.

The power divider 10 may consist of a circular polarizer section 11 coupled to a three-port divider section 12. The circular polarizer section 11 may be any convenient device for providing a first sense of circular polarization to the odd mode signals and an opposite sense to the even mode signals. For purpose of discussion the circular polarizer described herein comprises a hybrid mixer 14 having orthogonal input ports A and B to a cylindrical waveguide member 15. The hybrid mixer 14 provides an input means for combining the odd and even input modes into a single waveguide. The output port 16 of the waveguide member 15 is connected to the input port 18 of a polarizer section 19 which provides the odd and even mode signals with the opposite senses of circular polarization. The polarizer 19 includes a quarter-wave polarizer plate 20 in a cylindrical waveguide member 21. The quarter-wave plate 20 provides a clockwise circular rotation or polarization sense to the odd mode signals while also providing a counterclockwise sense to the even mode signals. The output port 16 and the input port 18 should have the same diameter for impedance matching purposes. As previously mentioned, any other method of generating circular polarized signals having opposite senses for odd and even mode signals may be used.

The output port 22 of the polarizer section 19 is connected to the input port 24 of the three-port divider section 12. the output port 22 and the input port 24 of waveguide members 21 and 25, respectively, should be the same diameter for impedance matching purposes. The power divider section 12 includes a cylindrical waveguide member 25 having a flanged input port 24 at one end. An end cap 26 is adjustably mounted within the second end of the cylindrical waveguide member 25 for adjusting the impedance of the power divider section 12. Upon achieving the proper impedance match and power division from the power divider section 12, in the testing process, the end cap 26 is brazed or soldered permanently in place. The power divider section 12 has three output ports 1, 2 and 3, located toward the second end of the circular waveguide member 25 and oriented at 360°/N and (N=3 ports) or 120° apart about the cylindrical surface. A circular wave entering the input port 24 of the power divider section 12 will provide a three phase output signal having a phase separation of 120° and equally divided output power. Thus, the phase separation is dependent only upon the angular separation between output ports.

In order to enhance the power division and impedance matching a three bladed septa 28 is mounted to the end cap 26. Each septum is separated from the adjacent septa by 120° and the septa 28 is oriented such that the individual septum falls approximately midway between the adjacent output ports. The length of the septa along the propagation direction of travel of the circular wave is experimentally determined. An impedance matching rod 29 is axially mounted to the junction of the leading edges of the septa 26. The length of the impedance matching rod 29 is also experimentally determined. Thus the matching rod 29, the septa 28, and the end cap 26 make up a movable or adjustable structure for providing the proper impedance match over the desired bandwidth. The septa 28 enhances the power division from the output ports 1, 2, and 3 by isolating each output port from the other and reflecting substantially all of the energy to the output ports. Other methods such as an assemblage of rods or a wire mesh may be used in lieu of the septa 28 for accomplishing the same function.

In operation, an odd mode signal, for example, having a clockwise polarized sense, is applied to the input port 24 of the 3 port power divider 12. As the signal has a circular polarization, the output phase is merely dependent upon the position of the output ports 1, 2, and 3 relative to the rotating signal. Thus, the output signals will be 120° out of phase with each other for a three port device. Since the output phases are dependent upon the angle of the output ports and the simple septa 28, the output phases will accurately be determined at the time of manufacture. Heretofore, the accuracy of power dividers was largely determined by extensive and complicated tuning techniques which are not as accurate as the present invention. The output phase for an even mode signal is similarly generated only having the opposite sense.

In order to obtain an output phase progression of 60° instead of 120°, the output from output port 3 is inverted. An inverter 31 may be any convenient device such as a waveguide being one half a wavelength long. Thus a 240° signal is by an inverter 31 to 60° and there is now a phase progression of 60°. The inverted signal is arbitrarily designated as 0° output port 1 becomes −60° and the signal from output port 2 becomes +60°. Thus the output signal from an odd mode input signal has a phase progression of: −60°, 0°, and +60° , while an even mode signal has a phase progression of +60°, 0°, and −60°.

The principles of the present invention apply to a power divider having N>3 output ports where N is an odd integer. For instance, if N equals 5, the power divider section would have five output ports oriented at 360/5° or 72° about the cylindrical waveguide 25. A five-bladed septa would also be disposed within the waveguide member 25. The output signals of (N-1)/2 or 2 output ports are inverted by inverters similar to inverter 31. Inverters are connected to output ports 3 and 4 which results in a phase progression, for an odd mode signal of −72°, −36°, 0°, +36°, and +72°.

A power divider having an even number of output ports may also utilize the principles of the present invention but may be limited usefulness, since the end result is a power divider having N output signals but only N/2 different phases. For example, if (N-1)/2 output signals are inverted and N equals 4 then two output ports must have inverters according to the present invention. The inversion of two signals results in two output ports having the same phase output signal and the other two output ports having another phase signal.

Referring more specifically to FIG. 2, the vector diagram illustrates the output signals from a dual mode three phase power divider according to FIG. 1. The vector $0_1$ represents the output phase of output port 1; vector $0_2$ represents the signal from output port 2; and the solid vector $0_3$ represents output port 3. It is noted that there are two vectors $0_3$ representing output port 3. The dashed vector $0_3$ represents the inverted output. Thus although the output ports are physically oriented at 120° intervals, their output signals are out-of-phase from each other by 60°. Thence, the output signals from an odd mode input signal are −60°, 0°, and +60° and the even mode signals are +60°, 0°, and −60° from the same respective output ports.

Referring briefly to FIG. 3, the vector diagram illustrates the output signals from a dual mode five phase power divider. As mentioned above, the principles of a three phase power divider are equally applicable to a five phase power divider. The output ports are oriented at 72° intervals and the output signals from ports 3 and 4 are inverted. The solid vectors $0_1$, $0_2$, $0_3$, $0_4$, and $0_5$ represent the output signals from output ports 1 through 5, respectively. The dashed vectors $0_3$ and $0_4$ represent the inverted signals from ports 3 and 4, respectively. The phases of the output signals of an odd mode input signal are −72°, −36°, 0°, +36°, and +72° and the even mode output signals are +72°, +36°, 0°, −36°, and −72°.

Referring now to FIG. 4, the utilization of a dual mode power divider in a transmitter system is now described. A typical 500 MHz transmit frequency band is broken up into 12 channelized bands identified as $F_1$, $F_2$, $F_3$ . . . Each channel is typically 36 MHz and there is a guard band between channels of 4 MHz. The odd channels ($F_1$, $F_3$, . . . ) are applied to one multiplexer 33 and the even channels ($F_2$, $F_4$, $F_6$, . . . ) are applied to another multiplexer 34. The output of the multiplexer 33 is connected to the A input port of the hybrid mixer 14. The output terminal of the even channel multiplexer 34 is connected to B input port of the hybrid mixer 14. The output ports of the mixer 14 are connected to the circular polarizer 17 which in turn is connected to the converter 12.

Output port 1 of the converter 12 is connected to isolator 36 which in turn is connected to the input port of a diplexer 37. Output port 3 of the converter 12 is connected to an isolator network 39 which is in turn connected to a inverter 31. The output terminal of the inverter 31 is connected to a diplexer 41. Output port 2 of the triphase converter 12 is connected to an isolator network 43 which in turn is connected to the input port of a diplexer 44. Each of the output ports 1, 2, and 3 provide one-third of the output energy to the transmitting antenna.

The transmit output ports of the diplexers 37, 41, and 44 are connected to antenna feed horns 46, 47, and 48, respectively. Each antenna feed horn provides one third of the transmit power to the transmitting antenna with a maximum phase error an amplitude variation of ± 1.5° and ± 0.15dB, respectively. The phase of the energy to the transmitter antenna is shown immediately above each feed horn. For example, odd frequency wave from the horn 46 has a phase of +60° while the even mode has a phase of −60°. Similarly, the phases of the other antenna feed horns are illustrated adjacent to each horn for the odd and even frequency modes.

The antenna pattern generated by a satellite antenna having three feed horns and using a power divider according to the present invention is illustrated as composite pattern 40. It can be seen that by dividing the radiating power into three equal portions, the coverage pattern is greatly enhanced. The shaded areas demonstrate the areas on the earth's surface which were heretofore not covered by a three feed horn antenna system in the prior art. However, by utilizing the present power divider which provides a very accurate power division and a precise phase from each output port, the radiated energy is more uniformly distributed about the coverage area.

Although the present invention has been shown and described with reference to a particular embodiment, nevertheless, various changes and modifications obvious to one skilled in the art to which the invention pertains are deemed within the purview of the invention.

What is claimed is:

1. A dual mode multiphase power divider, comprising:

input means for receiving at least first and second circularly polarized waves having at least first and second senses;

waveguide means coupled to said input means for propagating all said waves along said waveguide means from a first end to a second end; and N output ports equally spaced about said waveguide means for providing N output signals having a first phase progression in response to said first input wave and providing N output signals having a second phase progression in response to said second input wave, said N output ports being at least 3 and N being an odd integer, said N output ports being mounted at 360/N° about said waveguide means for providing 1/N of the output power from each of said output ports in response to each of said first and second circularly polarized signals.

2. The invention according to claim 1, comprising:

an N-bladed septa, having at least 3 blades, N being an odd integer, said N blades being disposed at 360/N°, said septa being within the second end of said waveguide and said blades being disposed between adjacent output ports for providing isolation therebetween and for providing impedance matching between said waveguide means and said output ports.

3. A dual mode multiphase power divider, comprising:

input means for receiving first and second circularly polarized waves having first and second senses;

waveguide means coupled to said input means for propagating said first and second waves along said waveguide means from a first end to a second end;

N output ports equally spaced about said waveguide means for providing N output signals having a first phase progression in response to said first input wave and providing N output signals having a second phase progression in response to said second input wave, said N output ports being at least 3 and N being an odd integer, said N output ports being mounted at 360/N° about said waveguide means; and inverter means coupled to (N-1)/2 output ports for inverting the respective output signal and providing first and second output signals having a phase progression of 180/N° and having first and second senses, respectively.

4. A dual mode multiphase power divider, comprising:

means for generating first and second circularly polarized waves having first and second senses, respectively;

circular waveguide means having first and second ends, said first end being coupled to said generating means, said second end being closed, said circular waveguide means propagating said first and second circular waves from said first end to said second end;

at least three output ports being equally spaced and radially disposed on said circular waveguide means, said output ports providing a first output signal having a predetermined phase progression and a first sense in response to said first wave and providing a second output signal having said predetermined phase progression and a second sense in response to said second wave; and a bladed septa having at least 3 blades being within the second end of said waveguide means and the blades being disposed between adjacent output ports for providing isolation therebetween and for providing impedance matching between said waveguide means and said output ports.

* * * * *